US010815652B2

(12) United States Patent
Ball

(10) Patent No.: US 10,815,652 B2
(45) **Date of Patent: *Oct. 27, 2020**

(54) STRAINER WITH IMPROVED FLOW

(71) Applicant: WCM Industries, Inc., Colorado Springs, CO (US)

(72) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/839,201

(22) Filed: Dec. 12, 2017

(65) Prior Publication Data

US 2018/0100299 A1 Apr. 12, 2018

Related U.S. Application Data

(63) Continuation of application No. 15/438,848, filed on Feb. 22, 2017, now Pat. No. 9,890,523, which is a continuation of application No. 14/208,970, filed on Mar. 13, 2014, now Pat. No. 9,637,897.

(60) Provisional application No. 61/780,206, filed on Mar. 13, 2013.

(51) Int. Cl.
*E03C 1/262* (2006.01)
*E03C 1/264* (2006.01)

(52) U.S. Cl.
CPC ..... *E03C 1/262* (2013.01); *E03C 1/264* (2013.01)

(58) Field of Classification Search
CPC ..... E03C 1/22; E03C 1/23; E03C 1/26; E03C 1/262; E03C 1/264
USPC ..... 4/292, 286, 287, 288; D23/259, 262
See application file for complete search history.

(56) References Cited

U.S. PATENT DOCUMENTS

| | | | | | |
|---|---|---|---|---|---|
| 287,246 | A | | 10/1883 | Coomber | |
| 765,131 | A | | 7/1904 | Croswell | |
| 843,968 | A | * | 2/1907 | Sharp | E03C 1/23 251/279 |
| 917,395 | A | * | 4/1909 | Wise | E03C 1/24 285/133.11 |
| 928,032 | A | | 7/1909 | Dawes et al. | |
| 944,046 | A | | 12/1909 | Perkins | |
| 1,092,579 | A | | 4/1914 | Kohler | |
| 1,330,909 | A | * | 2/1920 | Sharp, Jr. | E03C 1/23 4/684 |
| 1,334,407 | A | * | 3/1920 | Sharp, Jr. | E03C 1/23 4/651 |
| 1,388,327 | A | | 8/1921 | Cornelius | |

(Continued)

FOREIGN PATENT DOCUMENTS

| | | | | |
|---|---|---|---|---|
| WO | 02/063109 | | 8/2002 | |
| WO | WO-2006074504 | A1 * | 7/2006 | E03C 1/22 |

OTHER PUBLICATIONS

Official Action for U.S. Appl. No. 14/208,970, dated Aug. 13, 2015, 15 pages.

(Continued)

*Primary Examiner* — Erin Deery

(57) ABSTRACT

A wastewater strainer is provided that includes a strainer body that has at least one opening that enhances fluid flow through the strainer body and the wastewater plumbing to which it is interconnected. The strainer body includes a flange for engagement to the inner portion of a bathtub and a hub that is spaced from a lower edge of the strainer body.

20 Claims, 5 Drawing Sheets

(56) References Cited

U.S. PATENT DOCUMENTS

| | | | | | |
|---|---|---|---|---|---|
| 1,511,017 | A | * | 10/1924 | Binder | E03C 1/262 4/287 |
| 1,511,018 | A | * | 10/1924 | Binder | E03C 1/22 4/287 |
| 2,695,678 | A | | 11/1954 | Sisk | |
| 2,859,453 | A | * | 11/1958 | Bloch | E03C 1/23 251/236 |
| 3,380,081 | A | * | 4/1968 | Eilertson | A47K 1/14 137/454.2 |
| 3,393,409 | A | | 7/1968 | Politz | |
| 3,771,177 | A | | 11/1973 | Rogers | |
| 4,138,747 | A | | 2/1979 | Zijlstra | |
| 4,144,599 | A | | 3/1979 | Cuschera | |
| 4,146,939 | A | | 4/1979 | Izzi | |
| 4,339,832 | A | * | 7/1982 | Cuschera | E03C 1/22 4/286 |
| 5,692,248 | A | | 12/1997 | Ball | |
| 5,758,368 | A | | 6/1998 | Ball | |
| 5,832,545 | A | | 11/1998 | Pan | |
| D402,354 | S | | 12/1998 | Strong | |
| 6,066,119 | A | * | 5/2000 | Ball | A47K 1/14 4/286 |
| 6,226,806 | B1 | * | 5/2001 | Ball | E03C 1/22 4/286 |
| 6,317,906 | B1 | * | 11/2001 | Ball | A47K 1/14 4/288 |
| 6,418,570 | B1 | * | 7/2002 | Ball | A47K 1/14 4/295 |
| 7,032,254 | B1 | | 4/2006 | Dong | |
| 7,150,576 | B1 | | 12/2006 | Kambeyanda | |
| 8,424,123 | B2 | | 4/2013 | Svensson | |
| 8,813,272 | B2 | | 8/2014 | Ball | |
| D717,405 | S | | 11/2014 | Coronado | |
| 9,234,337 | B2 | | 1/2016 | Ball | |
| D762,825 | S | | 8/2016 | Walker | |
| 9,593,473 | B2 | | 3/2017 | Schulze | |
| 9,637,897 | B2 | | 5/2017 | Ball | |
| 9,657,469 | B2 | | 5/2017 | Edmonds | |
| 9,714,504 | B2 | | 7/2017 | Bird et al. | |
| 9,890,523 | B2 | | 2/2018 | Ball | |
| D817,463 | S | | 5/2018 | Curley | |
| D884,838 | S | | 5/2020 | Ball | |
| D884,839 | S | | 5/2020 | Ball | |
| 2001/0007159 | A1 | | 7/2001 | Ball | |
| 2006/0064809 | A1 | | 3/2006 | Isgro | |
| 2008/0290012 | A1 | | 11/2008 | Shih | |
| 2010/0000012 | A1 | | 1/2010 | Evans | |
| 2010/0275364 | A1 | | 11/2010 | Torres et al. | |
| 2013/0269100 | A1 | | 10/2013 | Ball | |
| 2014/0000022 | A1 | | 1/2014 | McLeod | |
| 2014/0053328 | A1 | | 2/2014 | Chen | |
| 2014/0182053 | A1 | | 7/2014 | Huang | |
| 2014/0259346 | A1 | | 9/2014 | Ball | |
| 2014/0325748 | A1 | | 11/2014 | Ball | |
| 2015/0040312 | A1 | | 2/2015 | Yang | |
| 2018/0305910 | A1 | | 10/2018 | Heipp | |
| 2019/0167043 | A1 | | 6/2019 | Beck | |

OTHER PUBLICATIONS

Official Action for U.S. Appl. No. 14/208,970, dated Jan. 14, 2016, 10 pages.

Official Action for U.S. Appl. No. 14/208,970, dated May 25, 2016, 11 pages.

Official Action for U.S. Appl. No. 14/208,970, dated Sep. 19, 2016, 17 pages.

Notice of Allowance for U.S. Appl. No. 14/208,970, dated Dec. 27, 2016, 8 pages.

U.S. Appl. No. 15/438,848, Office Action dated May 16, 2017, 12 pages.

U.S. Appl. No. 15/438,848, Notice of Allowance dated Sep. 20, 2017, 9 pages.

WATCO Bushing strainer, Part No. 01033CP, Date of first sale May 28, 2002, 1 page.

WATCO NuFit L&T, Part No. 01044CP, Date of first sale Mar. 10, 1998, 1 page.

WATCO Lav Drain, Part No. 11432CP, Date of first sale Jan. 10, 2005, 1 page.

U.S. Appl. No. 29/637,068, Restriction Requirement dated Aug. 8, 2019, 7 pages.

U.S. Appl. No. 29/637,068, Notice of Allowance dated Jan. 15, 2020, 7 pages.

U.S. Appl. No. 29/707,160, Notice of Allowance dated Jan. 22, 2020, 9 pages.

U.S. Appl. No. 29/733,657, Notice of Allowance dated May 29, 2020, 9 pages.

U.S. Appl. No. 29/731,361, Notice of Allowance dated May 28, 2020, 8 pages.

* cited by examiner

STRAINER WITH IMPROVED FLOW

This U.S. Non-Provisional application claims the benefit of U.S. patent application Ser. No. 15/438,848, filed Feb. 22, 2017, now U.S. Pat. No. 9,890,523, U.S. patent application Ser. No. 14/208,970, filed Mar. 13, 2014, now U.S. Pat. No. 9,637,897, and U.S. Provisional Patent Application Ser. No. 61/780,206, filed Mar. 13, 2013, the entire disclosures of which are incorporated by reference herein.

FIELD OF THE INVENTION

Embodiments of the present invention are generally related to wastewater strainers commonly found in bathtubs and other fluid-holding basins. Strainers are located at a low point of the bathtub and interconnect to a wastewater drain system associated with a drain port of the bathtub and provide a fluid conduit from the bathtub or basin to the wastewater drain system.

BACKGROUND OF THE INVENTION

Wastewater plumbing is interconnected to a bathtub, shower, or other fluid-holding basin (hereinafter "bathtub") by way of a strainer that prevents large items from entering the wastewater plumbing system. The strainer also accommodates a drain stopper. Referring now to FIG. 3, strainers 2 generally include an externally threaded 10 cylindrical body 6 with an outwardly extending flange 22. Strainers 2 also often include at least one arm 54 that extends from an inner surface 56 of the cylindrical body 6. The arm 54 or arms support a centrally-located hub 30. The hub 30 receives a post or carrier that operatively supports the drain stopper. Common strainers and drain stoppers are described in U.S. Pat. Nos. 5,758,368 and 6,418,570, the entirety of which are incorporated by reference herein.

Wastewater plumbing often includes a generally L-shaped elbow 18 having a flange 38 extending from its upper surface for contacting a bottom surface of the bathtub. The other end, i.e., a generally "horizontal portion 50 of the elbow, is interconnected to a pipe that extends generally parallel to the outer, lower surface of the bathtub. To interconnect the wastewater elbow 18 to the bathtub, the elbow flange 38 is placed adjacent to the bottom surface of the bathtub wherein a seal 42 is often positioned therebetween. The strainer 2 is then inserted into the drain outlet and external threads 10 are interconnected to internal threads 14 of the drain elbow. As the strainer 2 is tightened onto the elbow 18, the strainer flange 22 will engage the bottom, internal surface of the bathtub to secure the wastewater elbow and associated plumbing to the bathtub.

Because the strainer body 6 is often longer than the upper portion of the elbow that interfaces with the bathtub 52, a portion of the strainer body will obstruct the wastewater flow path defined by the inner surface of the horizontal portion 50 of the elbow 18. Stated differently, the strainer body 6 when interconnected to the elbow 18 will extend past the intersection of the upper portion 52 and the horizontal portion 50 of the elbow, which obstructs flow. As one of skill in the art will appreciate, the more the strainer body extends past the intersection, the greater the flow obstruction as fluid leaving the bathtub must first circumvent the strainer body sidewall before it can enter the horizontal portion of the elbow. Flow obstructions prevent water from quickly escaping the bathtub, which is not ideal in overflow situations, for example, when users rely on opening a drain stopper to quickly drain the bathtub.

Thus, it has been a long felt need in the field of plumbing to provide a wastewater strainer that enhances fluid flow from the bathtub. The following disclosure describes an improved strainer that minimizes obstructions commonly found in strainer/elbow interconnections.

SUMMARY OF THE INVENTION

It is one aspect of embodiments of the present invention to provide a wastewater strainer ("hereinafter "strainer") that enhances fluid flow from a bathtub or other fluid-holding basin. The contemplated strainer includes a strainer body and a flange extending from a top edge of the strainer body. The strainer also includes a hub supported by at least one arm. The hub receives a post or carrier that operatively receives a drain stopper that cooperates with the flange to prohibit fluid flow from the bathtub. Enhanced flow is provided by decreasing the strainer body length while maintaining the distance from the hub to the strainer flange. Extensions are provided that offset the arms from a lower edge of the strainer body, which allows the distance between the hub and strainer flange to be maintained. The distance between the hub and the strainer flange is, in some respects, important because stopper mechanisms in use require predetermined carrier length to function properly and, if the hub location is raised relative to the inner surface of the bathtub, the stopper will not engage the strainer flange to seal the bathtub. By shortening the strainer body, at least two openings in the strainer body sidewall are provided that coincide with the fluid conduit provided by the horizontal portion of the wastewater elbow. Thus, fluid flowing through the strainer body will flow directly from the strainer body to the horizontal portion of the elbow without having to circumvent the strainer body sidewall.

It is another aspect of the present invention to provide a wastewater strainer, comprising: a body having an upper edge and a lower edge; a flange extending from the upper edge; at least one extension extending from the lower edge; and an arm interconnected on a first end to the extension and on a second end to a hub positioned within the body.

It is still yet another aspect of the present invention to provide a wastewater strainer used in combination with drain plumbing associated with a water receptacle, comprising: a body adapted to fit within a first portion of an elbow, the body having an upper edge and a lower edge and including an opening associated with the lower edge, the opening generally coinciding with the inner diameter of a second portion of the elbow such that a fluid flow path from the body and the second portion of the elbow is generally unobstructed; and a flange extending from the upper edge of the cylindrical body.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, explain the principles of these inventions.

Figure 1:
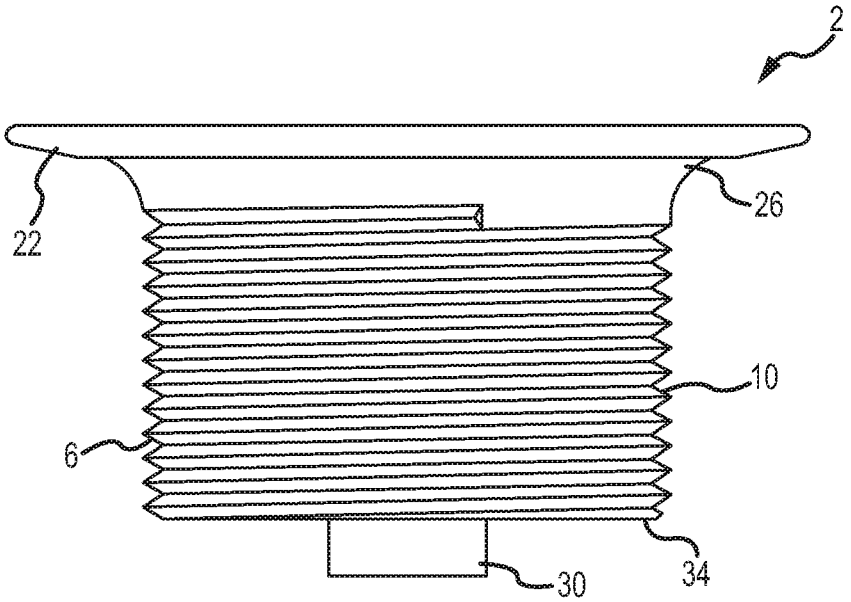
FIG.1 (PRIOR ART)
FIG. 1 is a front elevation view of a strainer of the prior art.

To assist in the understanding of one embodiment of the present invention the following list of components and associated numbering found in the drawings is provided herein:

| # | Component |
|---|---|
| 2 | Strainer |
| 6 | Strainer body |
| 10 | External threads |
| 14 | Internal threads |
| 18 | Drain elbow |
| 22 | Strainer flange |
| 26 | Upper edge |
| 30 | Hub |
| 34 | Lower edge |
| 38 | Drain flange |
| 42 | Seal |
| 46 | Conduit |
| 50 | Horizontal portion |
| 52 | Upper portion |
| 54 | Arm |
| 56 | Inner surface |
| 58 | Extension |
| 62 | Openings |
| 66 | Inner wall |
| 70 | Vertical portion |
| 74 | Hole |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
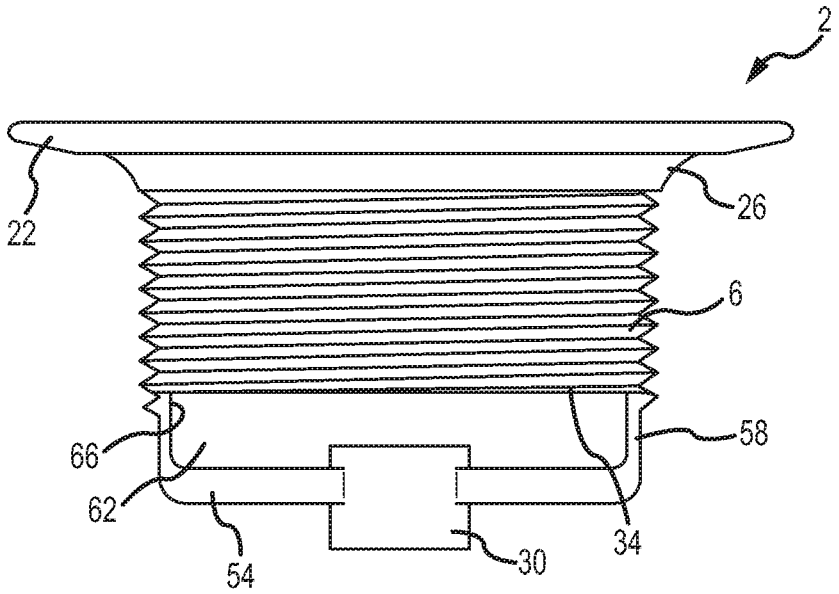
FIG. 2 is a front elevation view of a strainer of one embodiment of the present invention.
Figure 4:
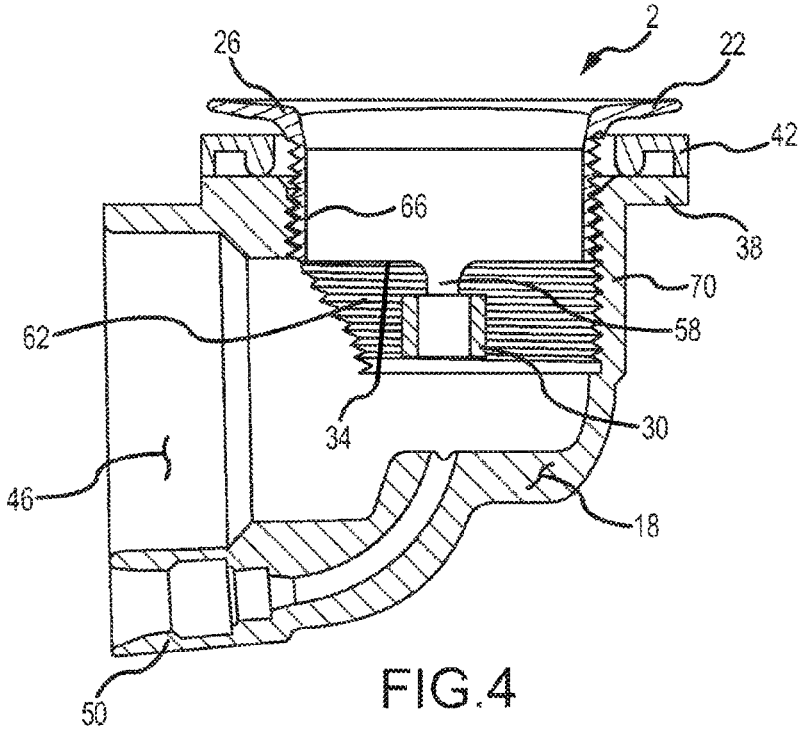
FIG. 4 is a cross-sectional view of the strainer of one embodiment of the present invention interconnected to an elbow of a wastewater plumbing system.
Figure 5:
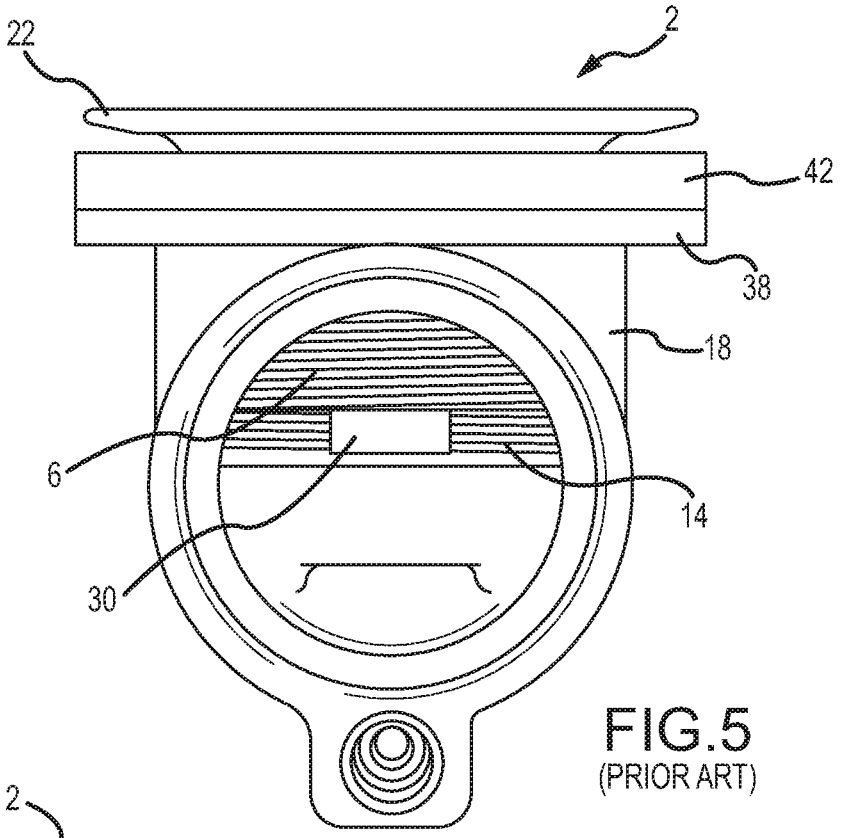
FIG.5 (PRIOR ART)
FIG. 5 is a left elevation view of the strainer of the prior art interconnected to an elbow of a wastewater plumbing system.
Figure 6:
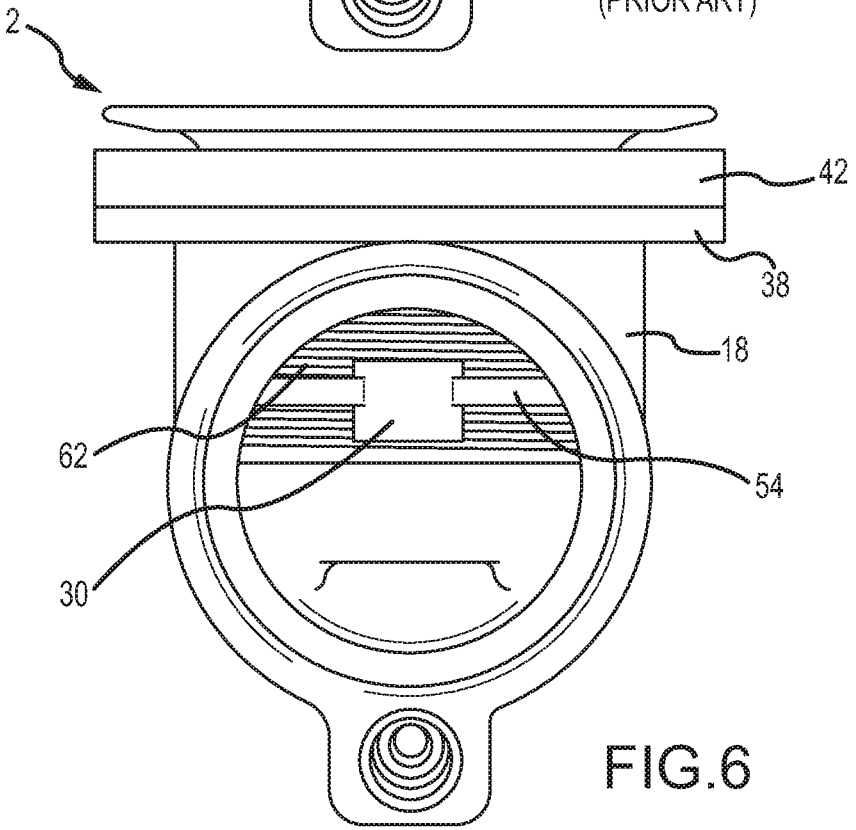
FIG. 6 is a left elevation view of the strainer of one embodiment of the present invention interconnected to an elbow of a wastewater plumbing system.
Figure 7:
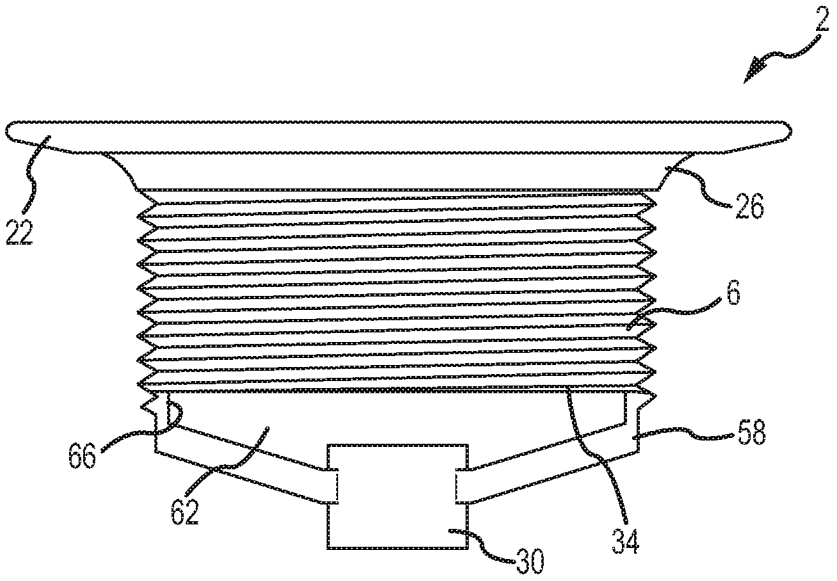
FIG. 7 is a side elevation view of one embodiment of the present invention that employs angled extensions.

FIGS. 2, 4, and 6 show a wastewater strainer 2 of one embodiment of the present invention that includes a strainer body 6 with external threads 10. The external threads 10 are designed to engage internal threads 14 of an elbow 18 of a wastewater plumbing system. The strainer 2 also includes a flange 22 positioned at an upper edge 26 of the strainer 2 and a hub 30 positioned adjacent its lower edge 34. The hub 30 receives a post or carrier associated with a drain stopper.

Figure 3:
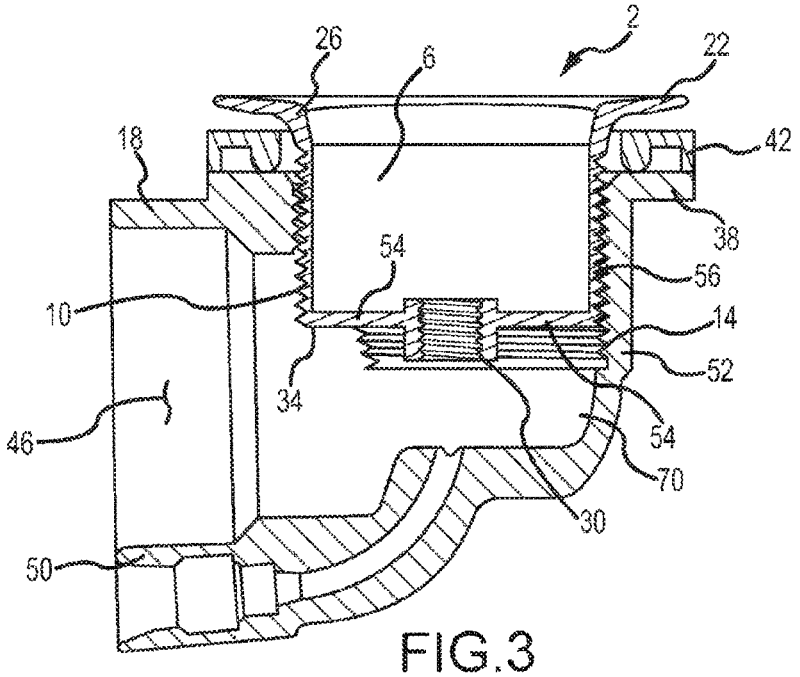
FIG.3 (PRIOR ART)
FIG. 3 is a cross-sectional view of the strainer of the prior art interconnected to an elbow of a bath wastewater plumbing system.

FIGS. 3 and 6 show the interconnection of a prior art strainer to an elbow that is positioned adjacent to the bottom portion of a bathtub (not shown) with a seal 42 positioned between the drain flange 38 and the bottom surface of the bathtub. To secure the drain elbow 18 and associated wastewater plumbing to the bathtub, the strainer 2 is first placed in a drain port of the bathtub and threadingly engaged into the elbow 18. As the strainer 2 is tightened onto the elbow 18, the strainer flange 22 will engage an inner bottom surface of the bathtub and compress the seal 42 to sandwich the bathtub wall between the strainer flange 22 and the drain flange 38. After this connection is complete, the drain stopper assembly (not shown) is interconnected to the hub 30.

As shown in FIG. 3, water flowing through the prior art strainer 2 would necessarily have to circumvent the lower edge 34 of the strainer body 6 to enter a conduit 46 provided by a generally horizontal portion 50 of the drain elbow 18. Again, this obstruction reduces mass flow through the drain elbow 18, which is undesirable.

FIGS. 2, 4, and 6 show one embodiment of the present invention that addresses the fluid flow problems previously described herein. More specifically, the strainer body 6 is shorter relative to the strainer body length of the prior art wherein the location of the hub 30 relative to the strainer flange 22 is maintained. That is, the location of the hub 30 and associated arms 54 with respect to the strainer flange 22 is maintained by extensions 58 interconnected to the lower edge 34 of the strainer body. This arrangement maintains the position of the hub 30 relative to the flange and creates openings 62 in the strainer body 6 that will allow water to flow more effectively.

FIGS. 4 and 6 show the interconnection of the strainer body of one embodiment. In operation, the strainer body 2 is threaded into the drain elbow 18 as in the prior art. Here, however, after interconnection, the lower edge 34 of the strainer body 6 is positioned close to an inner wall 66 of the horizontal portion 50 of the drain elbow 18. Thus, the arms 54 and hub 30 of the strainer body 6 create the only substantial flow obstruction and fluid does not have to circumvent an extended side wall of the strainer body to enter the conduit 46. The rotational position of the strainer relative to the elbow is irrelevant as at least two openings 62 are provided that allow the water to flow directly from the strainer body 6 to the horizontal portion 50 of the drain elbow 18.

One of skill in the art will also appreciate that the arms/extensions do not have to be formed in a 90° configuration as shown. More specifically, the arms 54 may be angled relative to the hub 30 and the inner wall 66 of the strainer body 6. In addition, one of skill in the art will appreciate that although two arms 54 are provided, more or less arms may be used without departing from the scope of the invention. For example, to prevent items from falling into the drain system, more arms 54 can be provided.

Alternatively, a single arm cantilevered from the extension may be provided to further increase the flow through the strainer body.

Although the openings are shown as providing a strainer body 6 with a relatively planar lower edge 34, one of skill in the art will appreciate that any strainer body 6 that has extensions 58 and that space the hub 30 away from the strainer flange 22 is contemplated. More specifically, the openings 62 may have an arcuate profile such that only the portion above the extensions has threads that engage the threads 14 of the drain elbow 18. In this fashion, the majority of the sidewall associated with the strainer body 6 would be removed. That is, any configuration that removes portions of the strainer body 6, while providing sufficient threads 10 for securely engaging with the threads 14 of the drain elbow 18 is contemplated and is within the scope of the present invention.

Figure 8:
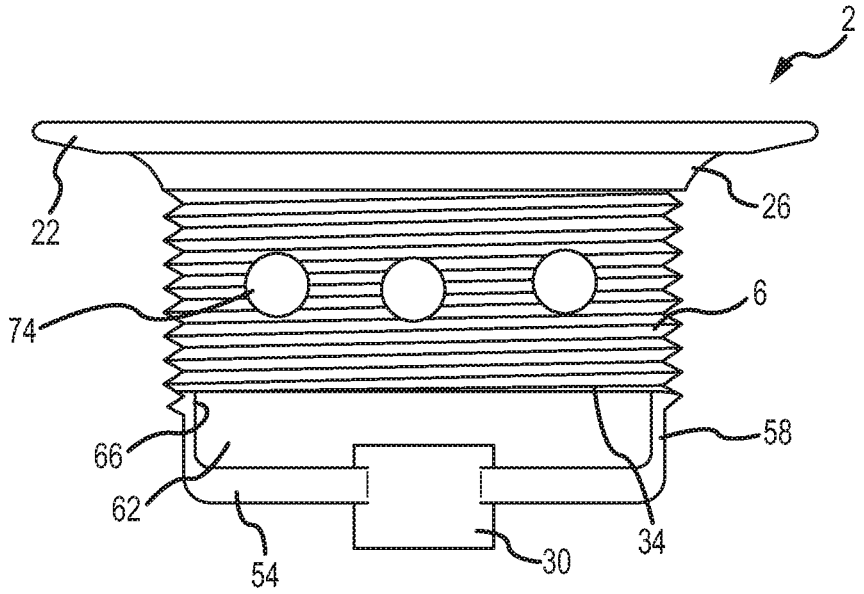
FIG. 8 is a side elevation of one embodiment of the present invention that employs a sidewall with a plurality of holes.

Further, as provided in FIG. 1, some embodiments employ extensions that directly interconnect to the hub. In these embodiments, the extensions are angled downwardly to position the hub at the correct distance below the strainer flange. Some other embodiments of the present invention as shown in FIG. 8 employ sidewalls with a plurality of holes that facilitate fluid flow. Here, although a traditional sidewall is used, the plurality of holes decreases the amount of fluid that must circumvent the sidewall.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A wastewater strainer comprising:

a body comprising an upper edge, an opposite lower edge, and a sidewall extending between the upper edge and the lower edge, wherein the body defines a longitudinal axis parallel to the sidewall;

a flange extending from the upper edge;

a hub positioned below at least a portion of the lower edge of the body by one or more connection members connected to at least a portion of the lower edge, wherein the hub comprises an upper surface that is positioned below the lower edge, wherein at least one opening for fluid flow is defined between at least a portion of the lower edge of the body and the upper surface of the hub, and wherein the at least one opening extends in both an axial direction relative to the longitudinal axis and a radial direction relative to the longitudinal axis; and at least one additional opening within the sidewall of the body.

2. The wastewater strainer of claim 1, wherein the one or more connection members each comprise an extension extending from the lower edge of the body and an arm supporting the hub.

3. The wastewater strainer of claim 2, wherein the arm is formed 90° relative to the extension.

4. The wastewater strainer of claim 2, wherein the arm is angled relative to the hub.

5. The wastewater strainer of claim 2, wherein at least a portion of the extension comprises external threads.

6. The wastewater strainer of claim 1, wherein the lower edge comprises at least one planar section.

7. The wastewater strainer of claim 1, wherein the one or more connection members comprises two connection members supporting the hub.

8. The wastewater strainer of claim 1, wherein the hub is configured to receive at least a portion of a drain stopper.

9. The wastewater strainer of claim 8, wherein the hub comprises internal threads.

10. The wastewater strainer of claim 1, wherein the body is cylindrical.

11. A wastewater plumbing system comprising:

an elbow comprising:

a horizontal portion having a first inner wall; and an upper portion having a second inner wall, wherein the first inner wall and the second inner wall define a conduit extending through the elbow, and wherein the first inner wall intersects with the second inner wall forming an inside corner and an outside corner, both the inside corner and the outside corner disposed within the conduit, the second inner wall comprising internal threads; and a wastewater strainer comprising:

a cylindrical body comprising an upper edge and an opposite lower edge, the body further comprising external threads;

a flange extending from the upper edge;

one or more connection members extending from the lower edge; and a hub supported by the one or more connection members, wherein the hub is positioned below the lower edge, and wherein at least one opening for fluid flow is defined between at least a portion of the lower edge of the body and the hub, and wherein the wastewater strainer is threadably connectable to the upper portion, and when the cylindrical body is engaged with the second inner wall, at least a portion of the lower edge does not extend past the inside corner and the hub is positioned below the inside corner.

12. The wastewater plumbing system of claim 11, wherein when the wastewater strainer is threadably connectable to the upper portion, the at least one opening is unobstructed by the inside corner.

13. The wastewater plumbing system of claim 11, further comprising a drain stopper supportable by the hub.

14. The wastewater plumbing system of claim 11, wherein the upper portion includes a drain flange extending therefrom.

15. The wastewater plumbing system of claim 14, further comprising a seal positionable between the drain flange and the flange of the wastewater strainer.

16. The wastewater plumbing system of claim 11, wherein the lower edge is planar.

17. The wastewater plumbing system of claim 11, wherein at least a portion of the lower edge is planar.

18. The wastewater plumbing system of claim 11, further comprising at least one hole defined within the body.

19. The wastewater plumbing system of claim 11, wherein the one or more connection members each comprise an extension extending from the lower edge of the body and an arm supporting the hub.

20. A wastewater plumbing system comprising:

an elbow comprising:

a horizontal portion having a first inner wall; and an upper portion having a second inner wall, wherein the first inner wall and the second inner wall define a conduit extending through the elbow, and wherein the first inner wall intersects with the second inner wall forming an inside corner and an outside corner, both the inside corner and the outside corner disposed within the conduit, the second inner wall comprising internal threads; and a wastewater strainer comprising:

a cylindrical body comprising an upper edge, an opposite lower edge, and a sidewall extending between the upper edge and the lower edge, the sidewall further comprising external threads, wherein the body defines a longitudinal axis parallel to the sidewall;

a flange extending from the upper edge;

one or more connection members extending from the lower edge; and a hub supported by the one or more connection members, wherein the hub comprises an upper surface that is positioned below the lower edge;

at least one opening for fluid flow defined between at least a portion of the lower edge of the body and the upper surface of the hub, and wherein the at least one opening extends in both an axial direction relative to the longitudinal axis and a radial direction relative to the longitudinal axis; and at least one hole defined within the sidewall of the body between the upper edge and the lower edge, wherein the wastewater strainer is threadably connectable to the upper portion.

* * * * *